US008254068B2

(12) United States Patent
Huang

(10) Patent No.: US 8,254,068 B2
(45) Date of Patent: Aug. 28, 2012

(54) REGULATING SYSTEM HAVING OVERVOLTAGE PROTECTION CIRCUIT AND CURRENT PROTECTION CIRCUIT

(75) Inventor: Yong-Zhao Huang, Shenzhen (CN)

(73) Assignees: Hong Fu Jin Precision Industry (ShenZhen) Co., Ltd., Shenzhen, Guangdong Province (CN); Hon Hai Precision Industry Co., Ltd., Tu-Cheng, New Taipei (TW)

( * ) Notice: Subject to any disclaimer, the term of this patent is extended or adjusted under 35 U.S.C. 154(b) by 45 days.

(21) Appl. No.: 12/862,765

(22) Filed: Aug. 25, 2010

(65) Prior Publication Data

US 2011/0235220 A1 Sep. 29, 2011

(30) Foreign Application Priority Data

Mar. 25, 2010 (CN) ..... 2010 1 0131982

(51) Int. Cl.
*H02H 3/20* (2006.01)
*H02H 9/04* (2006.01)
*H02H 3/08* (2006.01)
*H02H 9/02* (2006.01)

(52) U.S. Cl. ..... 361/18; 361/30; 361/91.1; 361/93.1

(58) Field of Classification Search ..... 361/18, 361/30, 91.1, 93.1
See application file for complete search history.

(56) References Cited

U.S. PATENT DOCUMENTS 3,818,273 A * 6/1974 Nakashima et al. ..... 361/59
4,189,670 A * 2/1980 Tanahashi ..... 323/267
7,715,216 B2 * 5/2010 Liu et al. ..... 363/89

OTHER PUBLICATIONS

TL431 Programmable Precision Reference, Data Sheet, 1998, Motorola, Inc, pp. 1-12.*

* cited by examiner

*Primary Examiner* — Rexford Barnie
*Assistant Examiner* — Zeev V Kitov
(74) *Attorney, Agent, or Firm* — Altis Law Group, Inc.

(57) ABSTRACT

A regulating system includes an input port having a first input terminal and a second input terminal, an output port having a first output terminal and a second output terminal, a regulating circuit, an over-current protection circuit, and an overvoltage protection circuit. The overvoltage protection circuit includes a regulating diode, a first bipolar transistor and a second bipolar transistor. The first output terminal is connected to the base of the first bipolar transistor via the regulating diode and grounded via first bipolar transistor. A base of the second bipolar transistor connects to the collector of the first bipolar transistor. The second output terminal is grounded via the second transistor. When an output voltage of the first output terminal increases over a predetermined voltage, an electrical connection between the second output terminal and ground is cut off to stop providing output voltage from the output port.

9 Claims, 1 Drawing Sheet

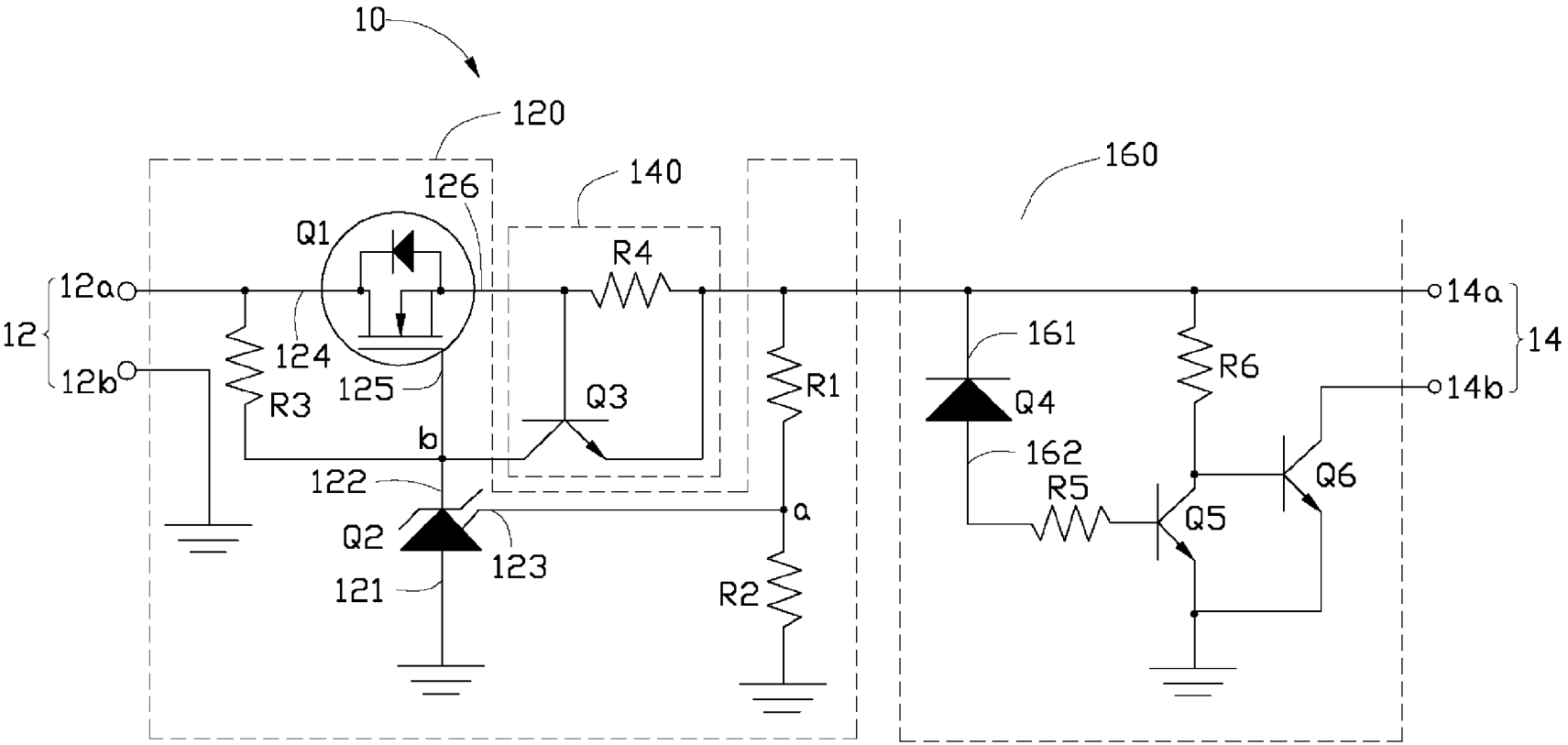
14
14a
14b
Q6
R6
Q5
160
161
Q4
162
R5
R1
a
R2
140
R4
Q3
120
126
123
10
Q1
125
b
122
Q2
121
124
R3
12a
12b
12

REGULATING SYSTEM HAVING OVERVOLTAGE PROTECTION CIRCUIT AND CURRENT PROTECTION CIRCUIT

BACKGROUND

1. Technical Field

The present disclosure relates to a regulating system, and more particularly, to a regulating system having an overvoltage protection circuit and a current protection circuit.

2. Description of Related Art

Power circuits are widely used in various electronic products such as computers notebooks, and LCD monitors. Normally, power circuits include a regulating system for regulating output voltage of the power circuits. However, the configuration of a typical regulating system is normally complicated.

Therefore, a new regulating system is desired to overcome the above-described shortcoming.

BRIEF DESCRIPTION OF THE DRAWINGS

The components in the drawings are not necessarily drawn to scale, the emphasis instead being placed upon clearly illustrating the principles of at least one embodiment. In the drawings, like reference numerals designate corresponding parts throughout the various views.

The drawing shows a circuit diagram of a regulating system according to one embodiment of the present disclosure.

DETAILED DESCRIPTION

Reference will now be made to the drawings to describe various inventive embodiments of the present disclosure in detail, wherein like numerals refer to like units throughout.

The FIGURE shows a regulating system 10 according to one embodiment of the present disclosure. The regulating system 10 includes an input port 12 and an output port 14. The input port 12 includes a first input terminal 12*a* and a grounded second input terminal 12*b*. The output port 14 includes a first output terminal 14*a* and a second output terminal 14*b*.

The regulating system 10 further includes a regulating circuit 120, an over-current protection circuit 140, and an overvoltage protection circuit 160. As shown in FIG. 1, the input port 12 is connected in series to the output port 14 via the regulating circuit 120, the over-current protection circuit 140, and the overvoltage protection circuit 160.

The regulating circuit 120 includes a metal oxide semiconductor (MOS) transistor Q1, a first resistor R1, a second resistor R2, a third resistor R3, and a regulating unit Q2. The MOS transistor Q1 includes a drain electrode 124, a gate electrode 125, and a source electrode 126. The regulating unit Q2 includes an anode 121, a cathode 122, and a reference terminal 123. The regulating unit Q2 can automatically adjust a voltage of the cathode 122 according to a voltage of the reference terminal 123. In one embodiment, the voltage of the cathode 122 increases following a voltage decrease of the reference terminal 123 and the voltage of the cathode 122 decreases following a voltage increase of the reference terminal 123. In one embodiment, the regulating unit Q2 is a three-terminal adjustable voltage regulator.

The drain electrode 124 of the MOS transistor Q1 connects to the first input terminal 12*a* of the input port 12. The gate electrode 125 of the MOS transistor Q1 connects to the cathode 122 of the regulating unit Q2 and connects to the first input terminal 12*a* via the third resistor R3.

The first resistor R1 and the second resistor R2 connects in series between the first output terminal 14*a* and ground. The cathode 122 of the regulating unit Q2 connects to the first input terminal 12*a* via the third resistor R3. The anode 121 of the regulating unit Q2 is grounded. The reference terminal 123 of the regulating unit Q2 connects to a node "a" between the first resistor R1 and the second resistor R2.

The over-current protection circuit 140 includes a first bipolar transistor Q3 and a fourth resistor R4. An emitter of the first bipolar transistor Q3 connects to the first output terminal 14*a*. A collector of the first bipolar transistor Q3 connects to the gate electrode 125 of the MOS transistor Q1. A base of the first bipolar transistor Q3 connects to the source electrode 126 of the MOS transistor Q1 and connects to the first output terminal 14*a* via the fourth resistor R4. In one embodiment, the first bipolar transistor Q3 is an npn bipolar transistor.

The overvoltage protection circuit 160 includes a regulating diode Q4, a fifth resistor R5, a sixth resistor R6, a second bipolar transistor Q5, and a third bipolar transistor Q6. The regulating diode Q4 includes a cathode 161 and an anode 162. The cathode 161 of the regulating diode Q4 connects to the first output terminal 14*a*. The anode 162 of the regulating diode Q4 connects to the base of the second bipolar transistor Q5 via the fifth resistor R5. A collector of the second bipolar transistor Q5 connects to the first output terminal 14*a* via the sixth resistor R6. An emitter of the second bipolar transistor Q5 is grounded. A base of the third bipolar transistor Q6 connects to the collector of the second bipolar transistor Q5. An emitter of the third bipolar transistor Q6 is grounded. A collector of the third bipolar transistor Q6 connects to the second output terminal 14*b*. In one embodiment, the second and the third bipolar transistors Q5 and Q6 are npn bipolar transistors.

The node "a" between the first resistor R1 and the second resistor R2 is defined to be a first reference point. A node "b" between the MOS transistor Q1 and the regulating unit Q2 is defined to be a second reference point.

In operation, the input port 12 receives a power supply from an external circuit (not shown). The regulating system 10 generates an output voltage and outputs it from the output port 14.

If the output voltage of the first output terminal 14*a* decreases, a first reference voltage of the first reference point, which is a divided voltage of the output voltage, is correspondingly decreased. Since the reference terminal 123 of the regulating unit Q2 connects to the first reference point, the voltage of the cathode 122 of the regulating unit Q2 increases following a voltage decrease of the reference terminal 123. Therefore, a voltage of the source electrode of the MOS transistor Q1 correspondingly increases based on the characteristic of the MOS transistor Q1 to compensate the voltage decrease of first output terminal 14*a*. On the contrary, if the output voltage of the first output terminal 14*a* increases, the first reference voltage of the first reference point is correspondingly increased. The voltage of the cathode 122 of regulating unit Q2 correspondingly decreases and the voltage of the source electrode of the MOS transistor Q1 correspondingly decreases to compensate the voltage increase of first output terminal 14*a*. In one alternative embodiment, a bipolar transistor can be used to replace the MOS transistor Q1.

Because an electrically conductive voltage between the base and the emitter of the first bipolar transistor Q3 is approximately equal to 0.7V, the first bipolar transistor Q3 turns on when the current flowing through the fourth resistor R4 increases to reach 0.7V divided by a resistance "r4" of the fourth resistor R4, namely 0.7V/r4. That is, the maximum voltage across the fourth resistor R4 is limited to be 0.7V by the first bipolar transistor Q3, a maximum current flowing through the fourth resistor R4 is approximately equal to 0.7V/r4. Therefore, the maximum current output from the output port 14 is also limited to 0.7V/r4 to achieve over-current protection function.

When the output voltage of the first output terminal 14*a* increases over a predetermined voltage, the regulating diode Q4 is reversed biased to turn on the second bipolar transistor Q5. The base of the third bipolar transistor Q6 is connected to ground via the activated third bipolar transistor Q6. Thus, the third bipolar transistor Q6 turns off to cut off the electrical connection between the second output terminal 14*b* and ground. Therefore, the output port 14 stops providing output voltage and the overvoltage protection circuit 160 performs an overvoltage protection function.

As described above, both the configuration and the principle of the regulating system 10 is simple.

It is to be understood, however, that even though numerous characteristics and advantages of certain inventive embodiments have been set out in the foregoing description, together with details of the structures and functions of the embodiments, the disclosure is illustrative only; and that changes may be made in detail, especially in matters of arrangement of parts within the principles of present invention to the full extent indicated by the broad general meaning of the terms in which the appended claims are expressed.

What is claimed is:

1. A regulating system, comprising:

an input port comprising a first input terminal and a second input terminal;

an output port comprising a first output terminal and a second output terminal; and a regulating circuit comprising a metal oxide semiconductor (MOS) transistor, a first resistor, a second resistor, a third resistor, and a regulating unit, wherein the first resistor and the second resistor connects in series between the first output terminal and ground, a reference terminal of the regulating unit connects to a node between the first resistor and the second resistor, an anode of the regulating unit is grounded, a cathode of the regulating unit connects to the first input terminal via the third resistor, a gate electrode of the MOS transistor connects to the cathode of the regulating unit, a drain electrode of the MOS transistor connects to the first input terminal;

an overvoltage protection circuit comprising a regulating diode, a first bipolar transistor and a second bipolar transistor, wherein a cathode of the regulating diode connects to the first output terminal, an anode of the regulating diode connects to a base of the first bipolar transistor via a fifth resistor, a collector of the first bipolar transistor connects to the first output terminal, an emitter of the first bipolar transistor is grounded, a base of the second bipolar transistor connects to the collector of the first bipolar transistor, an emitter of the second bipolar transistor is grounded, a collector of the second bipolar transistor connects to the second output terminal, when an output voltage of the first output terminal increases over a predetermined voltage, an electrical connection between the second output terminal and ground is cut off to stop providing output voltage from the output port; and an over-current protection circuit comprising a third bipolar transistor and a fourth resistor, wherein an emitter of the third bipolar transistor connects to the first output terminal, a collector of the third bipolar transistor connects to the gate electrode of the MOS transistor, a base of the third bipolar transistor connects to the source electrode of the MOS transistor and connects to the first output terminal via the fourth resistor.

2. The regulating system of claim 1, further comprising a resistor connected between the collector of the first bipolar transistor and the first output terminal.

3. The regulating system of claim 1, wherein the regulating unit is a three-terminal adjustable voltage regulator.

4. The regulating system of claim 3, wherein the regulating unit automatically adjusts a voltage of the cathode according to a voltage of the reference terminal.

5. The regulating system of claim 4, wherein voltage of the cathode of the regulating unit increases following a voltage decrease of the reference terminal of the regulating unit, voltage of the cathode of the regulating unit decreases following a voltage increase of the reference terminal of the regulating unit.

6. The regulating system of claim 1, wherein the first bipolar transistor, the second bipolar transistor, and the third bipolar transistor are npn bipolar transistors.

7. The regulating system of claim 1, wherein the input port receives power input from an external circuit.

8. The regulating system of claim 7, wherein the second input terminal of the input port is grounded.

9. The regulating system of claim 1, wherein the regulating system generates an output voltage outputted from the output port.

* * * * *